US007432433B2

(12) United States Patent
Boxer

(10) Patent No.: US 7,432,433 B2
(45) Date of Patent: Oct. 7, 2008

(54) METRONOME

(76) Inventor: Michael Boxer, Beckenhofstrasse 46, CH-8006 Zurich (CH)

( * ) Notice: Subject to any disclaimer, the term of this patent is extended or adjusted under 35 U.S.C. 154(b) by 366 days.

(21) Appl. No.: 10/528,132

(22) PCT Filed: Sep. 15, 2003

(86) PCT No.: PCT/CH03/00619

§ 371 (c)(1),
(2), (4) Date: Oct. 17, 2005

(87) PCT Pub. No.: WO2004/027524

PCT Pub. Date: Apr. 1, 2004

(65) Prior Publication Data

US 2006/0101983 A1 May 18, 2006

(30) Foreign Application Priority Data

Sep. 18, 2002 (CH) ..... 1577/02

(51) Int. Cl.
*G09B 15/00* (2006.01)

(52) U.S. Cl. ..... 84/484; 84/477 R

(58) Field of Classification Search ..... 84/484, 84/464 R, 477 R, 478
See application file for complete search history.

(56) References Cited

U.S. PATENT DOCUMENTS 4,321,853 A * 3/1982 Tumblin ..... 84/454
4,649,794 A * 3/1987 George ..... 84/484
5,275,082 A * 1/1994 Kestner-Clifton et al. . 84/477 B

FOREIGN PATENT DOCUMENTS

JP 55087982 A * 7/1980
JP 63243786 A * 10/1988

* cited by examiner

*Primary Examiner*—Lincoln Donovan
*Assistant Examiner*—Jianchun Qin
(74) *Attorney, Agent, or Firm*—Edwin D. Schindler

(57) ABSTRACT

The metronome serves for the optical and acoustic display of tempo, phase and the division of the phases of music pieces or movement rhythms. The above comprises a housing (1) with a display for the optical display of a movement which describes a curve (3) similar to a parabola. Means for controlling the display are further provided so that the optical movement oscillates with adjustable frequency and with additional means for the selective electrical generation of tones for acoustically marking the inflection points of the movement and for the selective further acoustic division of the time intervals between the inflection points of the movement. The display advantageously comprises a row of discrete light sources (2), arranged along a curve (3) similar to a parabola. The light sources (2) may be controlled such as to generate a moving light which oscillates back and forth along the row of light sources with adjustable frequency. Said metronome permits innumerable operational variations, however the most important advantage thereof is that the user may follow a rhythm more naturally, closely and precisely thanks to the display of the phase by an oscillation similar to a parabola and is thus carried along therewith.

13 Claims, 1 Drawing Sheet

METRONOME

BACKGROUND OF THE INVENTION

1. Technical Field of the Invention

Figure 1:
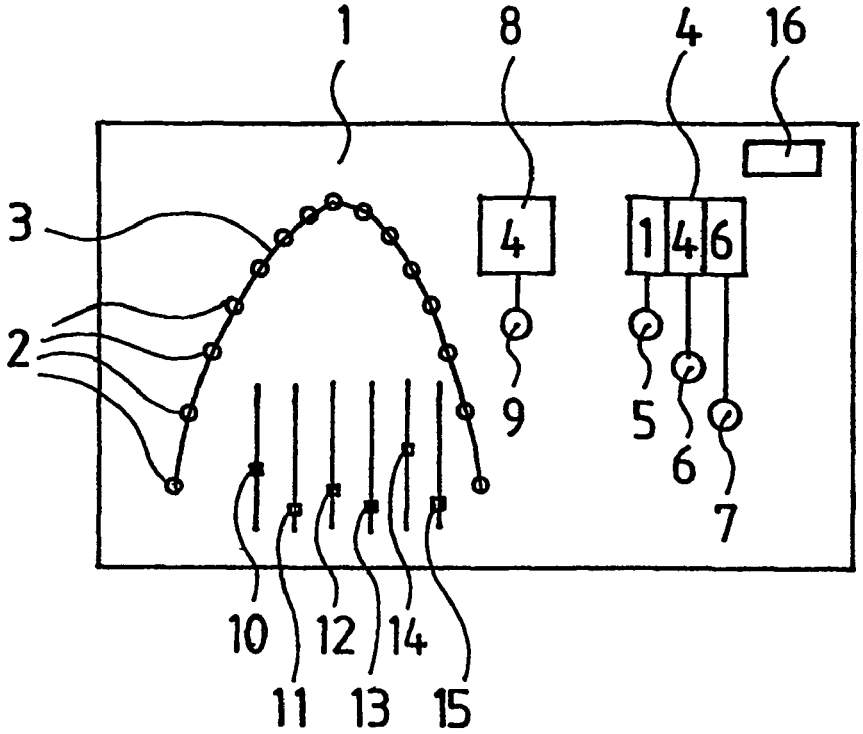

The invention relates to a metronome for the optical and/or acoustic display of the tempo, the [beat] time and the division of the [beat] times of pieces of music, for musicians, dancers, choreographers, gymnasts and for supporting rhythm or rhythmic movements very generally such as for users of speech therapies, for sportspersons of all types, etc.

2. Description of the Prior Art

Conventional metronomes which are most common today display the [beat] time of a piece of music by way of a pendulum rod which is pivotally articulated on a horizontal axis of a clockwork mechanism and may swing to and fro about this axis. It is driven by a spring-driven clockwork mechanism capable of being wound up. A mass piece which is displaceable on the pendulum rod with regard to the height position permits the change in the moment of inertia of the pendulum rod so that the swinging movement may be adjusted in its frequency. At the turning points of the pendulum rod, the clockwork mechanism causes a ticking or clicking sound which is similar to the sound of beating wood and thus acoustically displays the point in time of turning. Such a metronome mostly further comprises a bell which is actuated by a tapping mechanism which is likewise driven by the clockwork mechanism. Depending on the setting, the bell may be struck at each turning point, at each second one, at each third one, fourth or even at only each fifth turning point of the pendulum rod.

Such conventional metronomes optically as well as acoustically show the [beat] time at various settable frequencies, but they introduce the user to the rhythm in a restricted and inadequately natural and close manner. In the time intervals between the two turning points of the pendulum rod, the user is not guided at all or only in an unsatisfactory manner. To a certain extent he may merely estimate the temporal "position" of the subsequent turning point or acoustic beat only on account of the past, but is not guided up to this in a natural manner.

In recording studios, for multi-track dubbing of a piece of music or of a film one operates with a synchronous track, the so-called midi-code. This synchronous track corresponds to a standard. Via a microphone or a suitable interface, it is possible to carry out follow-ups that is to say post-dubbing or post-production in a vocal or instrumental manner or by way of a computer, synthesiser, sequencer or a percussion or base machine. Here one speaks of so-called "overdubs". Here however it is of utmost importance that a musician who is to post-dub an instrumental voice or a singer who is to post-dub a vocal tone, plays or sings very exactly in the [beat] time of the already recorded music. The slightest of deviations lead to recognisably poor results which lead to the fact often a dubbing needs to be started again several times until finally the desired quality is achieved. For this, expensive recording studio time is consumed. With an improved metronome which may also be activated by the synchronous track (for example midi), the dubber or post-dubber would be in the position of playing-in their recordings in a decisively more efficient manner and preparing them in a qualitatively perceivably improved manner so that many expensive studio hours could be saved. Due to the increased efficiency less "sound-sessions" or less lengthy "sound-sessions" would be required in order to play into a recording. Not only this, but every musician whether singer or instrument player may sharpen and more efficiently practice his feeling for the rhythm with a metronome which leads him better to the rhythm and accordingly leads him closely to this. But not only may musicians may improve with regard to rhythm, but sportsmen may improve there sequence of movements, and movement and speech therapists may help their patients in a more targeted and improved manner.

In the state of the art, from the Patent Abstracts of Japan, Publication No. 63243786 (Seiko Instr. & Electronics Ltd.) a metronome is known which displays a light source with which the individual light sources are arranged along a circular arc. The light signals illuminate successively at a constant period. At the ends of the circular arc the adjacent light sources lie closest together and in the middle furthest apart. For this reason the traveling light point is accelerated so that it is the slowest at the lower turning point and the greatest in the middle arc, thus in its upper zenith. This course of movement, however, does not correspond to a natural movement with which every person is acquainted. From WO 03/052528 (Taesung Ins. Co. Ltd.) a metronome is known which lights up a row of LEDs from the left to the right and from the right to the left in a rhythm with a selectable frequency so that this running light displays a uniform movement. Such a uniform movement may amongst other things be understood as a horizontal component of a trajectory-like movement.

SUMMARY OF THE INVENTION

The object of the present invention thus very generally lies in providing a metronome which to the first extent permits an improved rhythmic guidance of the user be it optically or acoustically or in combination with an optical and acoustic rhythm setting. For this, the metronome is to simulate a natural movement to which the user is acquainted, in particular, the movement of the center of gravity of a human which jumps on location with both legs or hops from one leg to the other. Every person is acquainted with this jumping movement and therefore it is natural an organic. Furthermore the metronome should also render various [beat] time subdivisions acoustically displayable.

Secondarily it is the object of the invention to specify such a metronome which simultaneously to this generally improved rhythmic guidance, also permits a dynamic acoustic guidance in that the user acoustically and in a dynamic manner may be led to a beat and may also be acoustically dissociated from this sound, also in a dynamic manner.

A third object of the invention its to realise an interactivity with a metronome, which permits the communication with the user in a targeted manner depending on the rhythmics of his song, play or manner of movement, in order to hint at an acceleration or slowing of his rhythm. As a whole, the display of the rhythm in each embodiment is to be effected in natural manner which is to say closer to the natural movement experience of the person, in a more familiar manner and in a more appropriate manner than the swinging to and fro of a pendulum rod.

The first object is achieved by a metronome for displaying the tempo, beat and the subdivision of the beat of pieces of music or movement rhythms with a battery-operated voltage source or with an electrical mains connection, which is characterised in that it includes a display for the optical display of a movement which describes an arc which includes a horizontal uniform movement component as well as a vertical accelerated movement component and thus describes a trajectory-parabola-like arc, and that means for activating the display are present so that the optical movement runs to and fro at a settable frequency.

The second object is achieved by a metronome for displaying the tempo, time and the subdivision of the time or of pieces of music or movement rhythms with a battery-operated voltage source or with an electrical mains connection, which is additionally characterised in that means are present for selectively producing sounds for the dynamic acoustic marking of the turning points of the movement and for the selective further acoustic subdivision of the time intervals between the turning points of the movement.

A third object is achieved by a metronome for displaying the tempo, time and the subdivision of the time of pieces of music or movement rhythms with a battery-operated voltage source or with an electrical mains connection, which is characterised in that it includes a display for the optical display of a movement which describes a trajectory-parabola-like arc, and that means for activating the display are present so that the optical movement runs to and fro at a settable frequency and/or that means are present for selective electrical production of sounds for the dynamic acoustic marking of the turning points of a movement and for the selective further acoustic subdivision of the time intervals between the turning points of the movement, as well as that a sensor and an electronic circuit with a software for detecting acoustic impulses are present, by way of which an optical or acoustic display of rhythm may be reproduced in dependence on settable run-ahead tolerances or settable run-behind tolerances of the rhythms recorded via the sensor.

Further embodiment variants of this metronome are described in detail by way of the drawings and their function is explained hereinafter.

BRIEF DESCRIPTION OF THE DRAWING FIGURES

Figure 2:
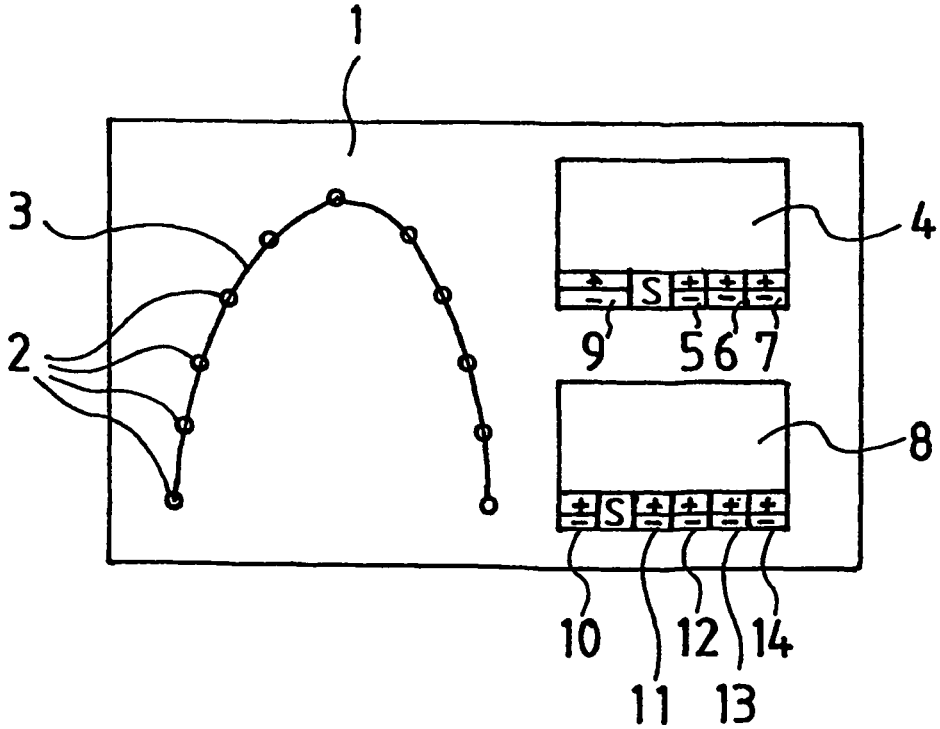

There are shown in:

FIG. 1 a metronome with a series of light sources arranged along an arc, with different distances between the individual light sources;

FIG. 2: a metronome with a series of light sources arranged along an arc, with uniform distances between the individual light sources;

DETAILED DESCRIPTION OF THE DRAWING FIGURES

FIG. 1 shows a metronome in a first embodiment variant. It consists of a housing 1 which selectively comprises a battery as a voltage source or an electrical mains connection. A number of discrete light sources 2 are arranged on the front side, and specifically along a row so that this light source row 3 forms an arc. This arc 3 here forms the display for the optical display of a movement which describes a trajectory-parabola-like arc. This arc 3 is parabolic as one may see, wherein the parabola looks similar to or is identical to a trajectory parabola. The distances between the individual light sources 2 are different. From the lowermost light sources the distances are reduced in an increasing manner until the distances are minimal at the apex of the parabola. The distances are dimensioned in a manner such that with a stationary frequency with which, beginning at a lower end of the light source row, the discrete light sources successively illuminate, a running light is produced in an optical manner which firstly runs rapidly and becomes increasingly slower towards the apex of the parabola, in order after passing the apex to become quicker again and to accelerate until reaching the other end of the parabola. The running light thus in principle describes exactly the movement of a trajectory body in the empty space of a gravitational field. The selection of the distances between the individual light sources determines the acceleration which acts on the running light, thus the fictive trajectory body. This trajectory-parabola-like movement of the running light corresponds to the natural movement which every person is naturally acquainted with. Every person experiences it when he moves in a running tempo, when he skips or when he alternately jumps to and fro from one foot to the other. Trials have shown that a musician is guided in a very much more precise and close manner by way of a rhythm displayed in such a manner and perceives it in this way much more spontaneously. Here it is clear that the steepness of the parabola branches may be varied, just as also the trajectory path of a trajectory body may run steeper or shallower depending on the angle of elevation at which the trajectory body is thrown or shot.

In a first embodiment variant shown here, the time intervals within which the light sources 2 of the arc-shaped arranged light source sequence successively light up remain constant. For this the distances between the individual light sources are variable as one may clearly recognise from the drawing. This are mathematically calculated on the basis of a trajectory parabola and the light sources are accordingly arranged at different distances so that the light sources 2 which illuminate at constant temporal intervals produce a running light which in the vertical with an upward movement are braked by a constant negative acceleration and reversely on moving downwards are accelerated with a constant positive acceleration. Mechanical, electrical or electronic activation means which belong to the metronome serve for the successive activation of the light surfaces 2 on the row of this parabola. With these activation means it may be the case of a mechanical clock which after every completed, constant but settable time interval closes an electrical contact which in each case brings the next light source 2 in the sequence to illuminate. The means may however also be designed in an electrical manner such as in the form of a Wagner's interrupter similar to an old-fashioned house bell. The distance between the hammer and the electromagnet then determines the frequency. The design which is less complicated and probably most economical is based on an electronic circuit with or without a microprocessor. Such an electronic circuit, specifically a microprocessor also without further ado has a data interface for activating other apparatus. Thus then a sequencer, a computer or an electrical instrument with the same frequency or electrical signals generated therefrom may be activated. Or in reverse, the metronome may also be activated by other apparatus via this interface, or data transmission may be carried out in order for example to load updates, new sounds, new presets or likewise.

Otherwise it is clear that the same or at least a similar effect of an optically displayed trajectory-parabola-like path is also achieved if the movement of the running light only approximately follows an ideal trajectory parabola. What is important is the natural jumping movement which every person is acquainted with and knows from a bouncing ball even though with the running light it is of course the case that an ideally bouncing, that is to say, non-damped jumping ball is simulated and any other influence of damping such as by way of the air resistance is eliminated.

In a second embodiment variant of the metronome, which is shown in FIG. 2, the light sources 2 are separated from one another at constant distances. In order despite this to simulate a trajectory-parabola-like movement with the running light, the time intervals between the illumination of the light sources is increased towards the apex of the parabola or arc 3, so that optically a slowing-down of the running light results, and after passing the apex, the running light in the same manner is optically accelerated in that the distances between the light sources again are increasingly shortened so that finally the same effect is achieved and the running light behaves in an optically equal manner or very similarly to a jumping or elastically bouncing ball. This special activation of the light sources after different time intervals is best of all provided by a microprocessor. Then the higher-order frequency, that is to say the time interval between the turning points of the running light may then be set via this microprocessor. Thus depending on the case, the running light jumps to and fro to a quicker or slower extent. With low frequencies there is optically very often the impression of a trajectory of a body which is recorded in slow motion, with rapid frequencies the impression of a trajectory of a body with a fast motion tempo. Somewhere between these lies a frequency at which the trajectory corresponds to a natural trajectory of a body under the influence of the earth's gravitation, admittedly whilst neglecting the air resistance. However to a certain extent the optical impression of the running light jumping to and fro like a ball acts in a very natural and familiar manner. Since the observer is optically guided between the turning points, he may very much more accurately estimate the point in time of the next turning point and accommodate this in his sense of rhythm. This may be selectively further encouraged by the acoustic display of the turning points. For this, on achieving the outermost light sources, an acoustic tone is electronically generated by the running light which has a great initial tip or rises to such a tip and then rapidly attenuates, similarly to an impacting and to some extent elastically bouncing-back ball.

If the metronome is equipped with a suitably programmed microprocessor, thus a whole series of natural functions may be set, for which the metronome has input knobs, input keys or program input keys and a display for displaying various variables. Some of these functions and displays are shown in the following. Thus FIG. 1 for example has a three-digit counter 4 each with a rotary knob 5, 6, 7 for each of the three digits of the counter 4. Furthermore one may see a separate counter 8 with an associated rotary knob 9. Five controls 10-14 in the form of slide controls are drawn, which may be displaced from a lower minimal position upwards to a maximal position there. An on/off switch 16 is located at the top on the right. The operation of this metronome is accomplished as follows. On switching on by way of actuating the on/off switch 16, the running light begins to run along the light sources 2 arranged in an arc like manner and then runs to and fro on both sides between the last light sources. Now by way of the rotary knobs 5, 6 and 7 the number of beats per minute may be set. The rotary knob 5 effects a setting of the hundreds, thus one hundred, two hundred, three hundred etc. beats, wherein these hundreds are displayed in the counter window 4 to the very left. The rotary knob 6 permits the setting of the tens and the rotary knob 7 the setting of the ones. As an example a beat number of 146 per minute has been set which usually corresponds to 146-quarter note per minute. A certain beat type may be set with the rotary knob 9. In FIG. 1 the associated counter 8 displays the value 4 which means the 4/4 time. If the counter displays the value 3, then a 3/4 beat is set, with the value 6 an 6/8 time. With the setting which has been carried out until now the metronome is ready for operation. In the shown setting example it sets a quarter time with 146 beats per minute, and since a quarter beat is set, in each case the first quarter note of each beat is displayed in an acoustic manner, thus always the one of four quarter note, that is to say one two three four one two three four etc. If the same number of beats per minute is selected with a three-quarter time, thus with a three of the display 8, then in each case the first quarter note of a three-quarter time is acoustically displayed, thus one two three one two three. The acoustic strength or the sound volume of this acoustic display may be regulated with the slide control 10. Optionally, further beats may be acoustically displayed with a certain set beat by way of producing an acoustic tone at suitable beat locations. The slide control 11 makes the first sixteenth of each quarter note sound at an high or lower volume depending on the slide position. The slide control 12 makes the second sixteenth of each quarter note sound, the slide controller 13 the third sixteenth of each quarter note, the slide controller 14 the fourth sixteenth of each quarter note, and the slide control 15 finally the second and third triole of each quarter note.

In the embodiment according to FIG. 2 all displays are effected in an electronic manner, which means by way of a liquid crystal LCF 4; 8. Instead of rotary knobs, here setting buttons 5,6,7; 9 and 10-14 are pushed, with in each case one plus button for increasing values and a minus button for reducing values. The setting may however also be effected via fewer buttons in that a single liquid crystal display is provided which has a menu guide at its disposal so that one after the other all desired values may be set with a plus/minus button and may be stored via a set function for example a $E^2$-PROM (Electrical Erasable Programmable Read Only Memory). The display for displaying the movement may also be a liquid crystal LCD on which the movement of a trajectory body is graphically displayed. In this case the metronome makes do without light sources.

Depending on the design of the metronome this may assume a multitude of functions which may be set on the metronome. Apart from the tempo, thus the number of beats per minute and the [beat] time type, one may also set the number of loops (default=∞), thus how many times the movement or the running light skips to and fro, and of course the total volume of the acoustic displays. Furthermore the starting point may be selected, thus whether the movement or the running light starts at the left or right. The tones which are superimposed on the movement or the running light may be set in quality and loudness. Thus the first beats of each beat may be acoustically displayed with various timbres and volumes. One may select whether the quarter note or eighth note or even a sixteenth note is to be acoustically displayed. Intermediate beats as are particularly usual in jazz music may be acoustically displayed, and each eighth note as an intermediate beat, or each triole individually or each sixteenth individually, etc. Furthermore various presets may be stored one after the other as one piece.

Particularly helpful functions are the counting modes. The counting mode consists of a preset with n loops, for example 4 to 8 loops. The metronome starts, the musician assumes the preset tempo and the metronome then stops itself after a defined number of [beat] times. The counting mode on the other hand consists of a preset with ∞ loops. The metronome runs after switching on until it is stopped by hand. A modified counting mode consists of presets which are composed into one piece. The metronome either constantly play the piece, or once or a defined number of runs.

The metronome may also be realised in a purely acoustically operating version. In this case means are merely present for the selective electrical production of tones for the dynamic and acoustic marking of the turning points of the movement and for the selective further acoustic subdivision of the time intervals between the turning points of the movement. Such and acoustic display of the turning points may also guide the user in a more natural manner with regard to rhythm. For this, a tone is synthetically produced which for example acoustically simulates the approach of a jumping or bouncing ball or which accompanies this. Typically a sound after the impact of a balls lasts. With a synthetically produced tone, on the forefront of the impact a tone may be displayed and with regard to its sounding or with regard to the frequency or volume may be changed so that acoustically one is led up to the point in time of the beat. Such a metronome which in a purely acoustic and natural, and quasi-smooth manner guides the user, is above all advantageous when one must look at the notes and may not look at an optical display.

Interactive functions may be realised with a data interface either with a purely optically acting metronome or with a purely acoustically acting metronome of the presented type. Thus the metronome may be provided with a microphone or a sensor in the form of a sensitive surface which cooperates with a pad or piezocrystal and an electronic pulse generator, with which as a one-off or in a permanent manner a tempo may be set by way of rhythmically pushing the buttons. The intervals between the continuously set base beats are measured and the tempo is determined, wherein the tolerance of the deviation of the set frequency may be set. If beats lie outside a set tolerance or if no setting is effected, then the metronome runs further with a constant tempo on account of the last valid tempo setting.

The interactivity may also permit errors to be recognised via an external or internal microphone. For example a tolerance may be inputted as a plus and/or minus value, and the metronome then by way of a comparison of the signal proceeding from the microphone or sensor tests the agreement with its preset base beats. The error may be displayed in an optical or acoustic manner. The musician may even be actively encouraged by the metronome to play slower or quicker until he again play synchronously with the metronome. Inputs from the microphone which lie after the first beat and before the second beat are acknowledged with "slower". Inputs after the first beat which enter after the second beat are accordingly acknowledged with "faster". In a particular mode the readings may also be cumulated and only displayed at the end. The metronome then continuously detects the deviation of the user from the preset rhythm in that it detects the acoustic or mechanical signals produced by the user via the microphone or the sensor and constantly displays the deviations. At the close the metronome may then for example display the cumulated reading in an optical or acoustic form, specifically how much percent the musician played too quickly or too slowly in comparison to the set tempo, or how many beats a user carried out in comparison to a predefined beat number. In total this metronome permits unforeseen operating variants. Its most important advantage however is to be seen in the fact that the user is guided to a rhythm in a much more natural, acquainted and close manner and thus is "guided along this" thanks to the display of the beat by way of a trajectory parabola-like to and fro movement.

The invention claimed is:

1. A metronome for displaying tempo, time and the subdivision of time, of pieces of music or movement rhythms, comprising:

a display for optically displaying movement depicting an arc having a horizontal, uniform movement component and a vertical, accelerated movement component depicting a trajectory-parabola arc, said display including a row of discrete light sources having individual light sources arranged along a trajectory-parabola arc;

means for activating said row of discrete light sources of said display for providing optical movement having a running light running to and fro along said row of discrete light sources at a settable frequency;

means for selective electrical production of sounds for an acoustic marking of turning points of the running light;

means for selective acoustic subdivision of time intervals between the turning points of the running light;

means for selecting acoustic tones of different frequencies, timbres and volumes; and, means for superimposing said acoustic tones of different frequencies, timbres and volumes on said optical movement so simulated, said means for selecting acoustic tones and said means for superimposing said acoustic tones being controlled by a microprocessor, so that volume and intensity of an acoustic tone increases over movement of said running lights over said individual light sources of said trajectory-parabola arc, or over a portion thereof, and upon reaching outermost light sources of said trajectory-parabola arc, achieves a maximum or intensity center and thereafter fades.

2. The metronome for displaying tempo, time and the subdivision of time, of pieces of music or movement rhythms according to claim 1, further comprising:

means for selective acoustic subdivision of time intervals between turning points of said optical movement;

a sensor; and, an electronic circuit having software for detecting acoustic impulses for an optical or acoustic display of rhythm reproduced and dependent on settable run-ahead tolerances or settable run-behind tolerances of rhythms recorded via said sensor.

3. The metronome for displaying tempo, time and the subdivision of time, of pieces of music or movement rhythms according to claim 1, wherein said row of discrete light sources have said individual light sources successively positioned at differing distances between successive said individual light sources, so that with time intervals between an illumination of said individual light sources remaining the same, a trajectory of a body is capable of being optically simulated with respect to said vertical, accelerated movement component of said optical movement, said trajectory undergoing a negative acceleration in an upwards movement and a positive acceleration in a down-wards movement, while said horizontal, uniform movement component of said optical movement remains uniform.

4. The metronome for displaying tempo, time and the subdivision of time, of pieces of music or movement rhythms according to claim 1, wherein said row of discrete light sources have said individual light sources successively positioned at constant distances between successive said individual light sources, so that successive activation at differing time intervals of said individual light sources, a running light is produced for optically simulating a trajectory of a body with respect to said vertical, accelerated movement component of said optical movement, said trajectory undergoing a negative acceleration in an upwards movement and a positive acceleration in a downwards movement.

5. The metronome for displaying tempo, time and the subdivision of time, of pieces of music or movement rhythms according to claim 4, further comprising:

means for setting a symmetrical or asymmetrical tolerances to predefined metronome beats for detecting rhythms produced by a user, so that when said symmetrical or asymmetrical tolerances are exceeded by the user, cumulated measurement results and instructions for accelerating or decelerating user-rhythm are optically produced via a display or acoustically produced via a loudspeaker.

6. The metronome for displaying tempo, time and the subdivision of time, of pieces of music or movement rhythms according to claim 5, wherein said means for setting a symmetrical or asymmetrical tolerances to predefined metronome beats for detecting rhythms produced by a user include a microprocessor with software.

7. The metronome for displaying tempo, time and the subdivision of time, of pieces of music or movement rhythms according to claim 1, further comprising a setting display for setting and displaying a numerical count of said turning points of optical movement within a given time period and beat type and type of acoustic subdivision of each beat.

8. The metronome for displaying tempo, time and the subdivision of time, of pieces of music or movement rhythms according to claim 1, further comprising a setting display for setting and displaying a numerical count of said running light within a given time period and beat type and type of acoustic subdivision of each beat.

9. The metronome for displaying tempo, time and the subdivision of time, of pieces of music or movement rhythms according to claim 1, further comprising a digital counter for setting and displaying a number of said turning points of said running light within a given time period.

10. The metronome for displaying tempo, time and the subdivision of time, of pieces of music or movement rhythms according to claim 9, further comprising:

means for selectively setting beat type; and, a display for displaying said beat type selectively set.

11. A metronome for displaying tempo, time and the subdivision of time, of pieces of music or movement rhythms, comprising:

a display for optically displaying movement depicting an arc having a horizontal, uniform movement component and a vertical, accelerated movement component depicting a trajectory-parabola arc, said display including a row of discrete light sources having individual light sources arranged along a trajectory-parabola arc;

means for activating said row of discrete light sources of said display for providing optical movement having a running light running to and fro along said row of discrete light sources at a settable frequency;

means for selective electrical production of sounds for an acoustic marking of turning points of the running light;

means for selective acoustic subdivision of time intervals between the turning points of the running light;

means for selecting acoustic tones of different frequencies, timbres and volumes; and, means for superimposing said acoustic tones of different frequencies, timbres and volumes on said optical movement so simulated, said means for selecting acoustic tones and said means for superimposing said acoustic tones being controlled by a microprocessor for successively activating said individual light sources with a time interval for producing a running light for optically simulating a trajectory of a body with respect to said vertical, accelerated movement component of said optical movement, said trajectory undergoing a negative acceleration in an upwards movement and a positive acceleration in a downwards movement, so that volume and intensity of an acoustic tone increases over movement of said running lights over said individual light sources of said trajectory-parabola arc, or over a portion thereof, and upon reaching outermost light sources of said trajectory-parabola arc, achieves a maximum or intensity center and thereafter fades.

12. The metronome for displaying tempo, time and the subdivision of time, of pieces of music or movement rhythms according to claim 11, further comprising:

means for setting a symmetrical or asymmetrical tolerances to predefined metronome beats for detecting rhythm produced by a user, so that when said symmetrical or asymmetrical tolerances are exceeded by the user, cumulated measurement results and instructions for accelerating or decelerating user-rhythm are optically produced via a display or acoustically produced via a loudspeaker.

13. The metronome for displaying tempo, time and the subdivision of time, of pieces of music or movement rhythms according to claim 11, wherein said means for setting a symmetrical or asymmetrical tolerances to predefined metronome beats for detecting rhythms produced by a user include a microprocessor with software.

* * * * *